US006220681B1

(12) United States Patent
Swensson et al.

(10) Patent No.: US 6,220,681 B1
(45) Date of Patent: Apr. 24, 2001

(54) ARMOIRE WITH BUILT IN DESK

(75) Inventors: Earl S. Swensson, Franklin; David S. Gilbert, Mt. Juliet, both of TN (US)

(73) Assignee: Wellness, LLC, Nashville, TN (US)

( * ) Notice: Subject to any disclaimer, the term of this patent is extended or adjusted under 35 U.S.C. 154(b) by 0 days.

(21) Appl. No.: 09/354,422

(22) Filed: Jul. 15, 1999

Related U.S. Application Data

(63) Continuation-in-part of application No. 29/101,761, filed on Mar. 11, 1999, now Pat. No. Des. 429,089, and a continuation-in-part of application No. 29/101,762, filed on Mar. 11, 1999, now Pat. No. Des. 427,805.

(51) Int. Cl.[7] ..... A47B 97/00

(52) U.S. Cl. ..... 312/292; 312/325; 312/238; 312/315

(58) Field of Search ..... 312/321.5, 405.1, 312/327, 328, 231, 233, 238, 292, 298, 300, 313, 315, 223.5, 319.2, 325; 108/38, 39, 134, 6, 7, 9; D6/441, 445, 432, 434

(56) References Cited

U.S. PATENT DOCUMENTS

| | | | | |
|---|---|---|---|---|
| D. 31,695 | | 10/1899 | Thompson . | |
| 264,210 | * | 9/1882 | Waterman | 312/305 X |
| D. 310,756 | | 9/1990 | Pauer et al. . | |
| D. 358,046 | | 5/1995 | Ferguson . | |
| D. 360,088 | | 7/1995 | Walters, III et al. . | |
| D. 363,393 | | 10/1995 | Berry, Jr. et al. . | |
| D. 363,836 | | 11/1995 | Paus . | |
| D. 371,020 | | 6/1996 | Paus . | |
| D. 375,000 | | 10/1996 | Paus . | |
| D. 375,001 | | 10/1996 | Keller et al. . | |
| D. 375,420 | | 11/1996 | Keller et al. . | |
| D. 382,138 | | 8/1997 | Mann . | |
| D. 387,580 | | 12/1997 | Walters, III et al. . | |
| 750,193 | * | 1/1904 | James | 312/315 X |
| 1,193,867 | * | 8/1916 | Buckley | 312/315 X |
| 2,468,473 | | 4/1949 | Underwood . | |
| 2,819,139 | * | 1/1958 | Stevenson | 312/238 X |
| 3,202,470 | | 8/1965 | Lage . | |
| 4,219,248 | | 8/1980 | Goldberg . | |
| 4,317,606 | | 3/1982 | Hastings . | |
| 5,082,336 | * | 1/1992 | Munch et al. | 312/292 |
| 5,322,364 | * | 6/1994 | Kasparbauer, Jr. | 312/204 |
| 5,383,724 | * | 1/1995 | Wrangberth et al. | 312/325 |
| 5,516,203 | | 5/1996 | Branham et al. . | |
| 6,062,663 | * | 5/2000 | You et al. | 312/306 X |

FOREIGN PATENT DOCUMENTS

| | | | | |
|---|---|---|---|---|
| 1051899 | * | 1/1954 | (FR) | 312/325 |
| 413106 | * | 7/1934 | (GB) | 108/38 |

* cited by examiner

*Primary Examiner*—Janet M. Wilkens
(74) *Attorney, Agent, or Firm*—Waddey & Patterson Lucian Wayne Beavers

(57) ABSTRACT

An armoire includes an enclosure having an opening defined therein. A door is located in the opening and is connected to the enclosure by a vertical hinge. A desk panel is mounted in the outside of the door and is connected to the door by a pair of four-bar linkages. The enclosure, the door and the desk panel all have convexly curved exterior surfaces, so that when the door is closed and the desk panel is closed, the convex exterior surfaces are co-extensive.

18 Claims, 6 Drawing Sheets

ARMOIRE WITH BUILT IN DESK

Be it known that we, Earl S. Swensson and David S. Gilbert, have invented a new and useful "Armoire With Built In Desk." This application is a continuation-in-part of our prior applications Ser. No. 29/101,761, entitled ARMOIRE, filed Mar. 11, 1999, now U.S. Pat. No. 0,429,089 and Ser. No. 29/101,762, entitled ARMOIRE WITH SHELVES, filed Mar. 11, 1999.

BACKGROUND OF THE INVENTION

1. Field of the Invention

The present invention relates generally to furniture construction, and more particularly, but not by way of limitation, to an armoire.

2. Description of the Prior Art

There is a continuing need for multi-functional furniture. This is particularly true in environments such as health care rooms or hotel rooms where space is at a premium.

One such typical prior art device is the conventional "secretary" which has a flat front usually made of glass or wooden doors, with a flat table which can be tilted up to a sloped closed position covering a portion of a desktop, and which can be tilted down to a flat desk top position.

SUMMARY OF THE INVENTION

The present invention provides a furniture apparatus including an enclosure having an opening defined therein. One particular such furniture apparatus is furniture of the type commonly referred to as an armoire, which has a door which opens to provide access to an interior closet.

The present invention provides a door located in the opening of the enclosure. A door hinge connects the door to the enclosure so that the door pivots on the door hinge about a generally vertical axis relative to the enclosure.

A desk panel is mounted in the outside of the door, and a desk hinge connects the desk panel to the door so that the desk panel pivots relative to the door between a retracted position wherein the desk panel is received in the door, and an extended position wherein the desk panel extends outwardly from the door.

The front surface of the piece of furniture has a convex curved outer surface. Both the door and the desk panel include convex curved outer surfaces, such that when the desk panel is in its retracted position and the door is closed, the convex outer surfaces of the desk panel, the door and the overall piece of furniture are substantially co-extensive thus presenting an aesthetically pleasing piece of furniture with a convexly curved outer surface.

Preferably the desk hinge comprises a pair of four-bar linkage hinge mechanisms located on opposite sides of the desk panel so that the desk panel pivots about a varying horizontal axis as the desk panel moves from its retracted position to its extended position. The use of such a hinge solves the problem of how to provide a horizontal axis of rotation for a hinged connection of a component which has a convexly curved lower edge.

The apparatus also may include a hidden light fixture for illuminating the desk when the desk is in an open position.

The apparatus also includes a leveler mechanism connected between the desk panel and the door for adjusting a tilt of the desk panel when the desk panel is in its open position.

It is therefore, an object of the present invention to provide an improved furniture structure.

Another object of the present invention is the provision of a multi-functional furniture structure comprising both an armoire and a desk.

Another object of the present invention is the provision of a retractable desk having a convexly curved outer surface when the desk is in its retracted position, and utilizing a four-bar linkage hinge mechanism to allow pivotal movement about the arcuate lower outer edge of the desk panel.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
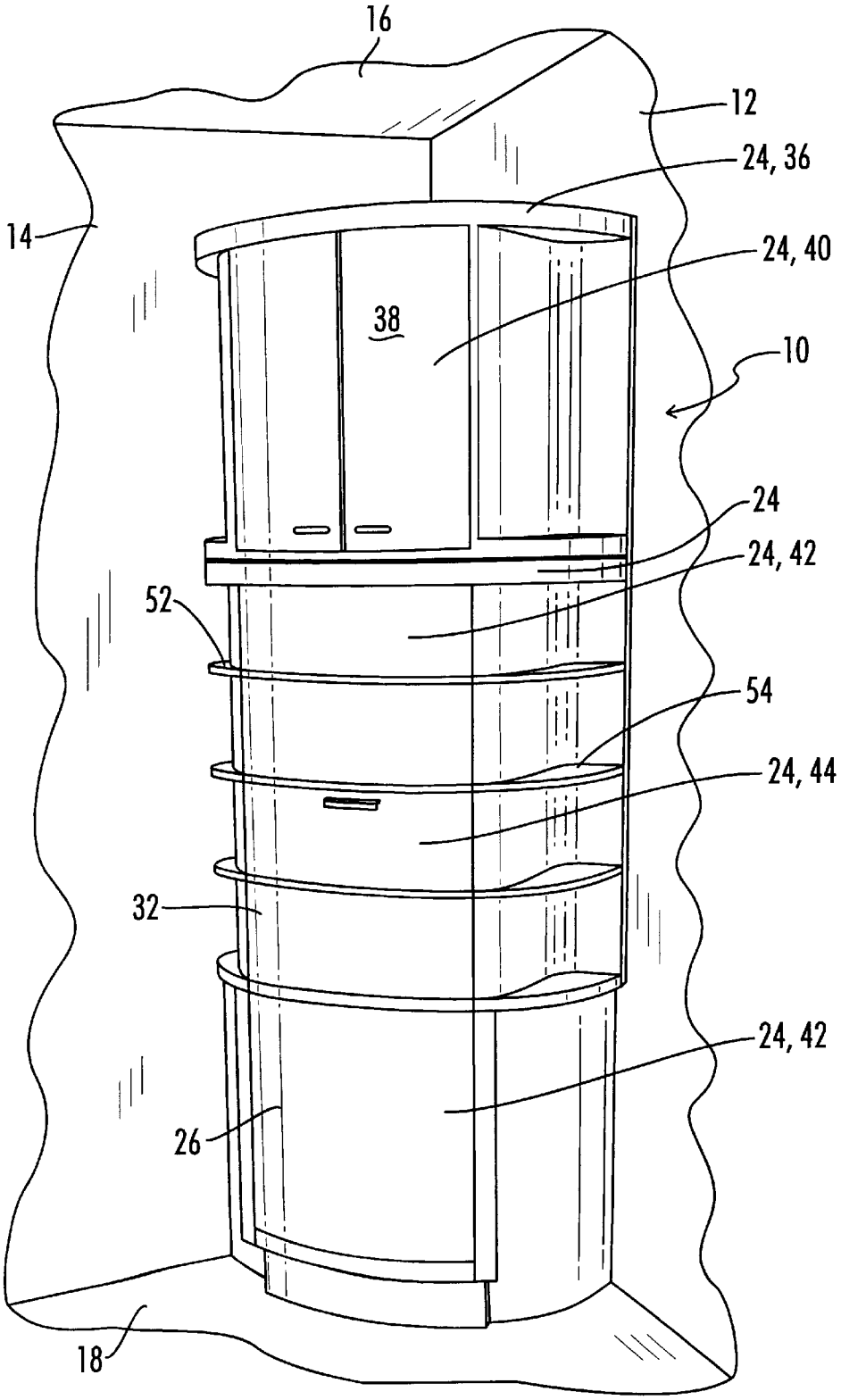
FIG. 1 is a perspective view of the armoire of the present invention having its door closed with the desk also in a closed position.
Figure 2:
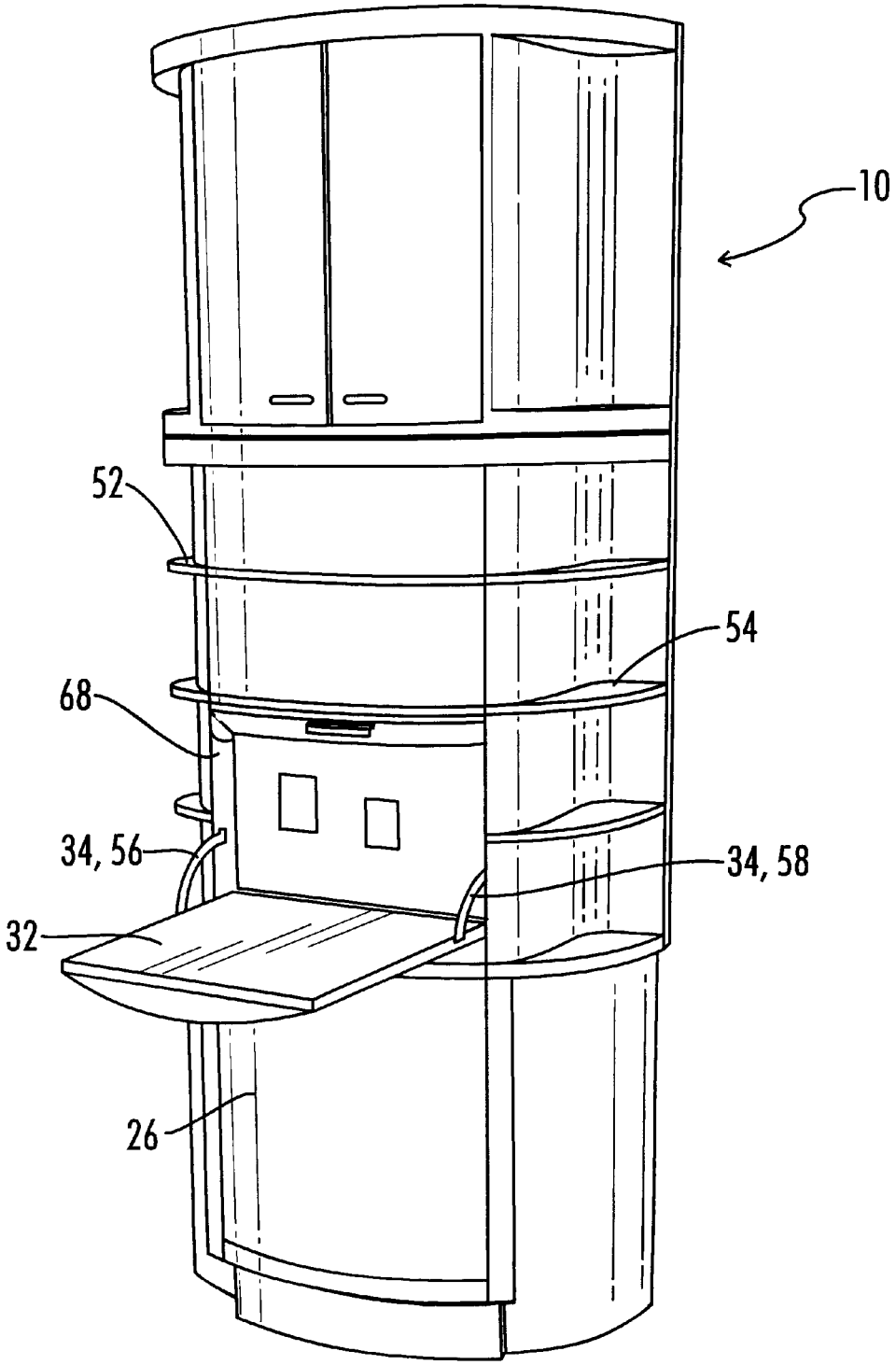
FIG. 2 is a view similar to FIG. 1 showing the desk in its open position.

Referring now to the drawings, and particularly to FIGS. 1 and 2, the furniture apparatus of the present invention is shown and generally designed by the numeral 10. The furniture apparatus 10 may also be referred to as the armoire 10.

In FIG. 1, the armoire 10 is shown in place in the corner of a room which is defined by the converging walls 12 and 14 of the room. Also visible are the ceiling 16 and floor 18 of the room.

Figure 3:
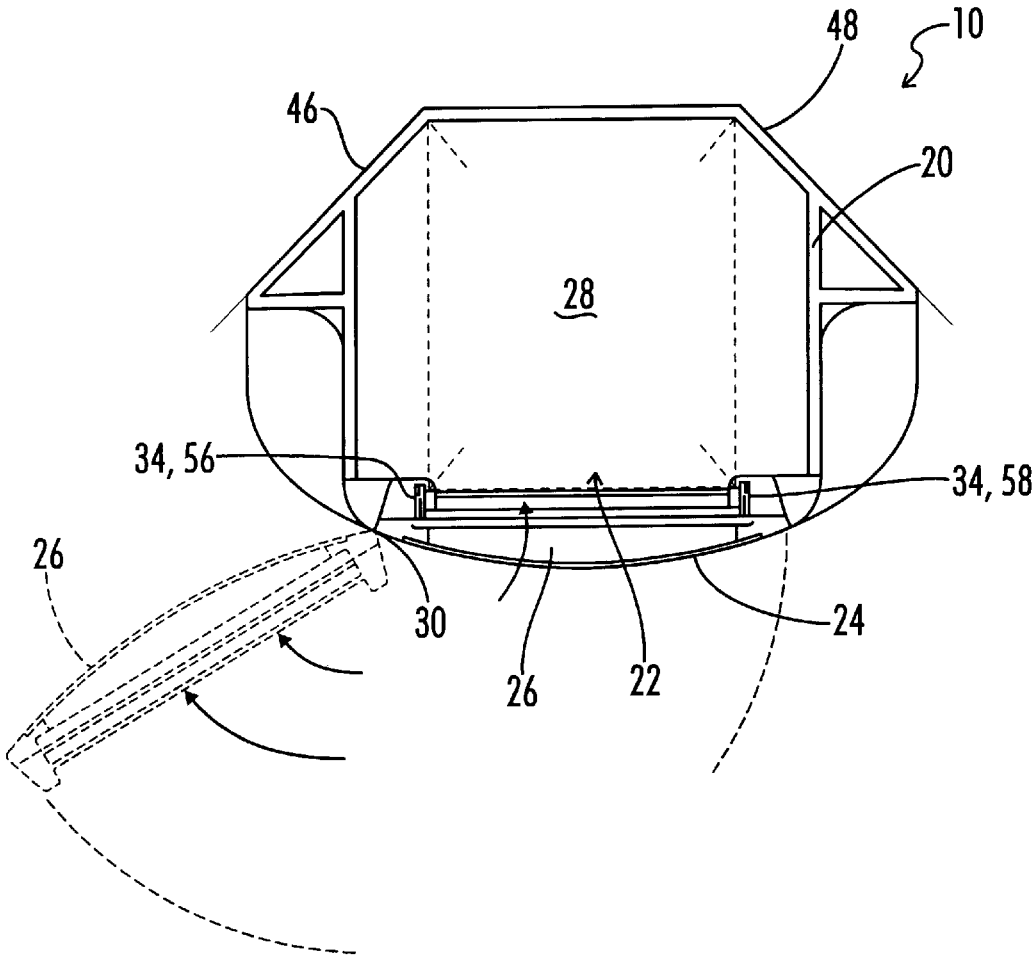
FIG. 3 is a plan view of the apparatus of FIG. 1, showing the door in a closed position in solid lines and in an open position in dashed lines.

FIG. 3 is a plan view of the armoire 10. The armoire 10 includes a wooden enclosure structure 20 which may also be generally referred to as the primary structure 20 which has an opening 22 defined in a front surface 24 thereof.

Figure 4:
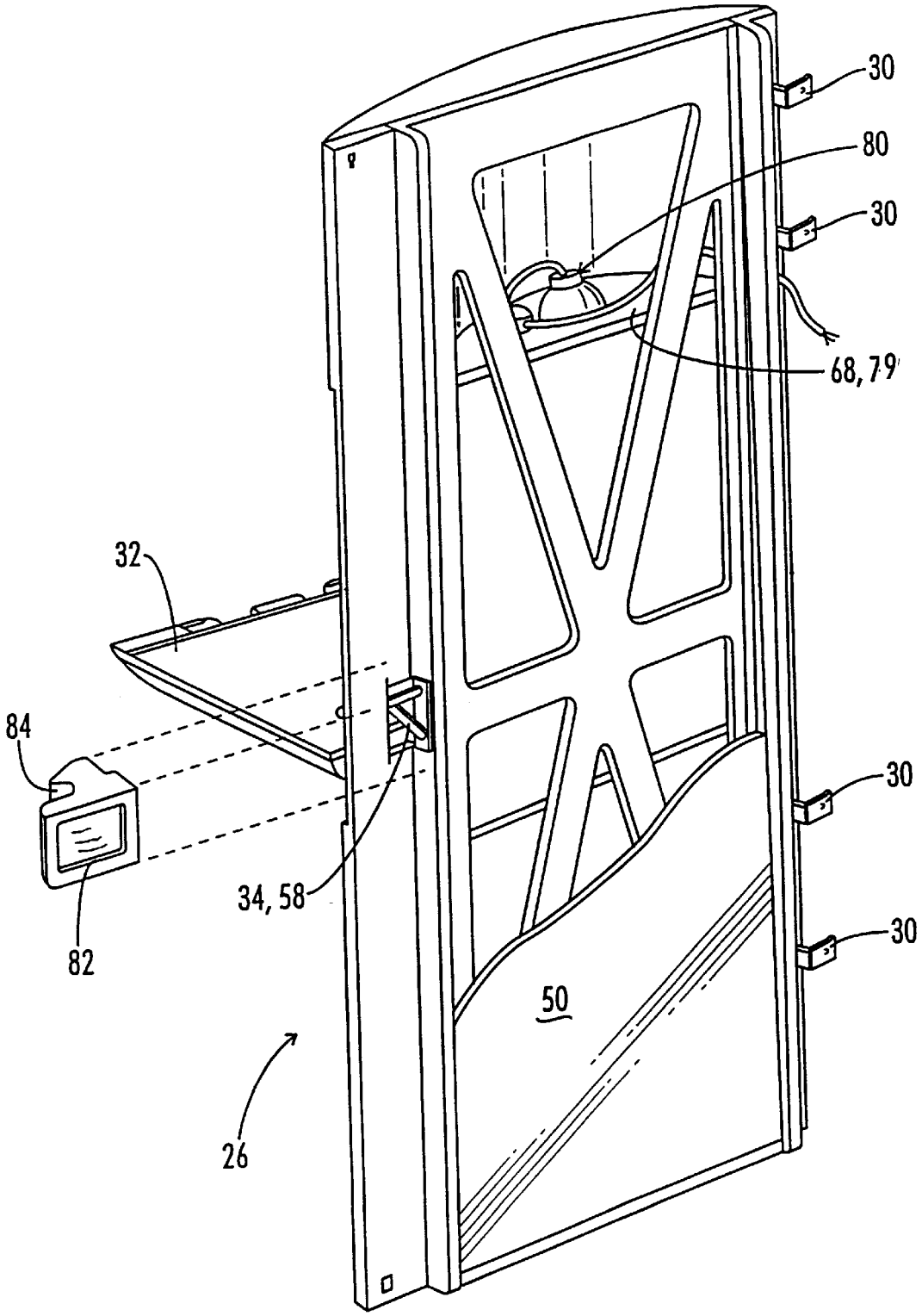
FIG. 4 is a perspective view from the rear of the door showing elements of the door construction, showing the desk in an open position, and showing the location of the four-bar linkage hinge mechanism. Additionally, a hinge cover is shown in exploded view in relation to the door.

A door 26 is located in the opening 22. As seen in FIG. 3, the door 26 may pivot between a closed position as shown in solid lines wherein the door blocks the opening 22, and an open position as shown in dashed lines wherein the opening 22 is open so that an interior closet space 28 may be accessed through the opening 22. A door hinge 30 connects the door 26 to the enclosure 20 so that the door 26 pivots about a generally vertical axis relative to the enclosure 20. As best seen in FIG. 4, the door hinge 30 may comprise a plurality of separate spaced hinge elements.

As best seen in FIG. 2, a desk panel 32 is mounted in the outside of the door 26. A desk hinge 34 connects the desk panel 32 to the door 26 so that the desk panel 32 pivots relative to the door 26 between a retracted position as shown in FIG. 1, wherein the desk panel 32 is received in the door 26, and an extended position as shown in FIG. 2, wherein the desk panel 32 extends outwardly from the door 26.

The retracted position of the desk panel 24 shown in FIG. 1 may also be referred to as an upper storage position or simply as a closed position. The extended position of the desk panel 32 shown in FIG. 2, may also be described as a lower use position or simply an open position.

As previously noted, the front surface 24 of the armoire 10 has a convex curvature when seen in plan view as in FIG. 3. This convex curvature has been chosen for aesthetic reasons, but as further described below, it causes complications in designing and constructing the mechanism by which the desk panel is connected to the door.

As can be seen in FIG. 1, wherein the door is closed and the desk is closed, the convex outer surface 24 of the armoire 10 is actually defined by many different individual components, all of which have outer perimeters that lie generally co-extensive so that in plan view they define the convexly curved outer surface 24. Just some of the components which comprise the convex outer surface 24 include the following.

The wooden enclosure 20 includes various fixed structural components, such as facia 36, which, in part, define the outer surface 24.

Located above the door 26 is a television cabinet 38 which is closed by doors, such as 40, which, in part, define the convex outer surface 24.

The door 26 itself has an outer surface 42 which may be defined as a door outer surface 42 which is a portion of the convex surface 24.

And, the desk panel 32, when in its closed position as shown in FIG. 1, includes a desk panel outer surface 44 which forms a portion of the convex outer surface 24.

Thus, when the door 26 is closed and the desk panel 24 is closed, the door outer surface 42 and desk panel outer surface 44 lie generally co-extensive with the convex curved outer surface 24 so as to appear a part thereof.

As seen in the plan view of FIG. 3, the armoire 10 includes at least two planar backwall segments 46 and 48 which are arranged complementary to and abut against the converging walls 12 and 14 of the room within which the armoire 10 is placed. The convexly curved front surface 24 can be described as facing away from the backwall segments 46 and 48.

The particular embodiment of the armoire 10 illustrated in the drawings is constructed to be placed in a 90° corner of a room. It will be appreciated, however, that by modifying the angle between backwall segments 46 and 48, the armoire 10 could be constructed to fit in a corner of less than or greater than 90°. Indeed, the backwall segments 46 and 48 could be coincident so that the armoire 10 has a straight back wall for placement against a flat wall surface of a room.

As previously noted, the armoire 10 includes an interior closet space 28 defined therein, which is accessible by opening the door 26. When the door 26 is opened, the user may view themselves in a full length mirror 50 mounted on the inside of the door 26, as seen in FIG. 4. The mirror 50 is preferably a lightweight plastic mirror.

As is apparent in FIG. 1, there is an integral television cabinet 38 located above the door 26. Also, located on either side of the door 26, are a plurality of integral shelves such as 52 and 54.

THE DESK HINGE MECHANISM

The convex curved outer surface 44 of the desk panel 32 provides a unique difficulty in the hinged mounting of the desk panel 32 to the door 26. Conventional hinges, such as piano hinges or other straight hinges cannot be utilized, because the lower edge of the desk panel 32 is curved. The use of straight hinges would cause the desk panel 32 to bind upon the hinges.

Figure 6:
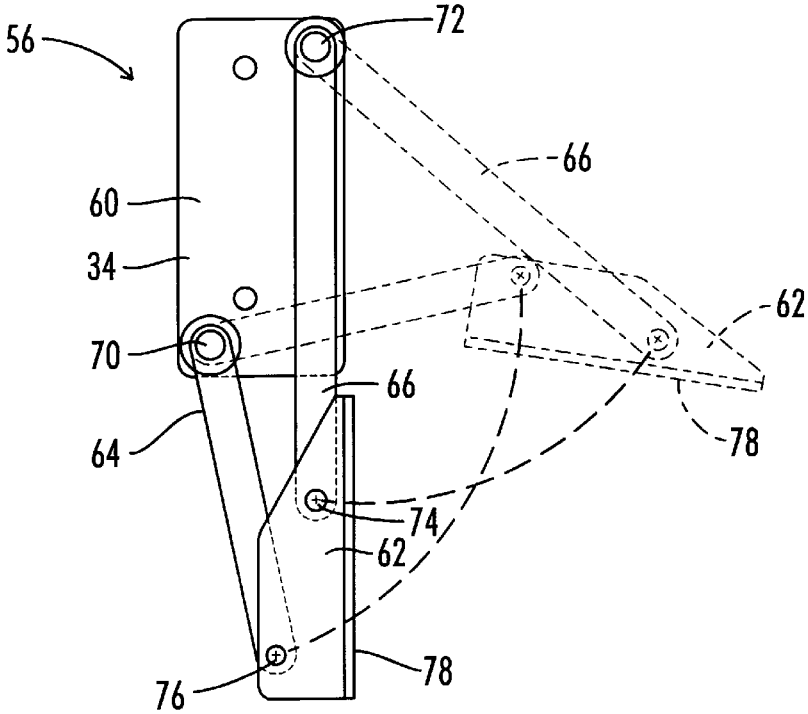
FIG. 6 is an elevation view of a four-bar linkage hinge mechanism for the desk panel. The mechanism is shown in solid lines in a position corresponding to the closed position of the desk panel, and in dashed lines in a position corresponding to the open position of the desk panel.

Thus, the present invention utilizes a desk hinge 34 comprised of two hinge mechanisms 56 and 58 on opposite sides of the desk panel 32. An elevation view of the left hand hinge mechanism 56 is shown in FIG. 6. The hinge mechanism 56 is shown in solid lines in a position corresponding to the closed position of the desk panel 32 analogous to FIG. 1, and the hinge mechanism 56 is shown in dashed lines in a position corresponding to the open position of desk panel 32 analogous to FIG. 2.

The hinge mechanism 56 is of the type generally referred to in the field of kinematics as a four-bar linkage. The four "bars" of the linkage include a first plate 60, a second plate 62, and two arms 64 and 66.

As seen in FIG. 2, the door 26 has a generally rectangular framework 68 which defines a generally rectangular forward facing opening 69 within which the desk panel 32 is received when the desk panel 32 is in a closed position. Preferably a forward facing surface 71 behind opening 69 is constructed as a fabric covered metal surface for magnets.

Figure 5:
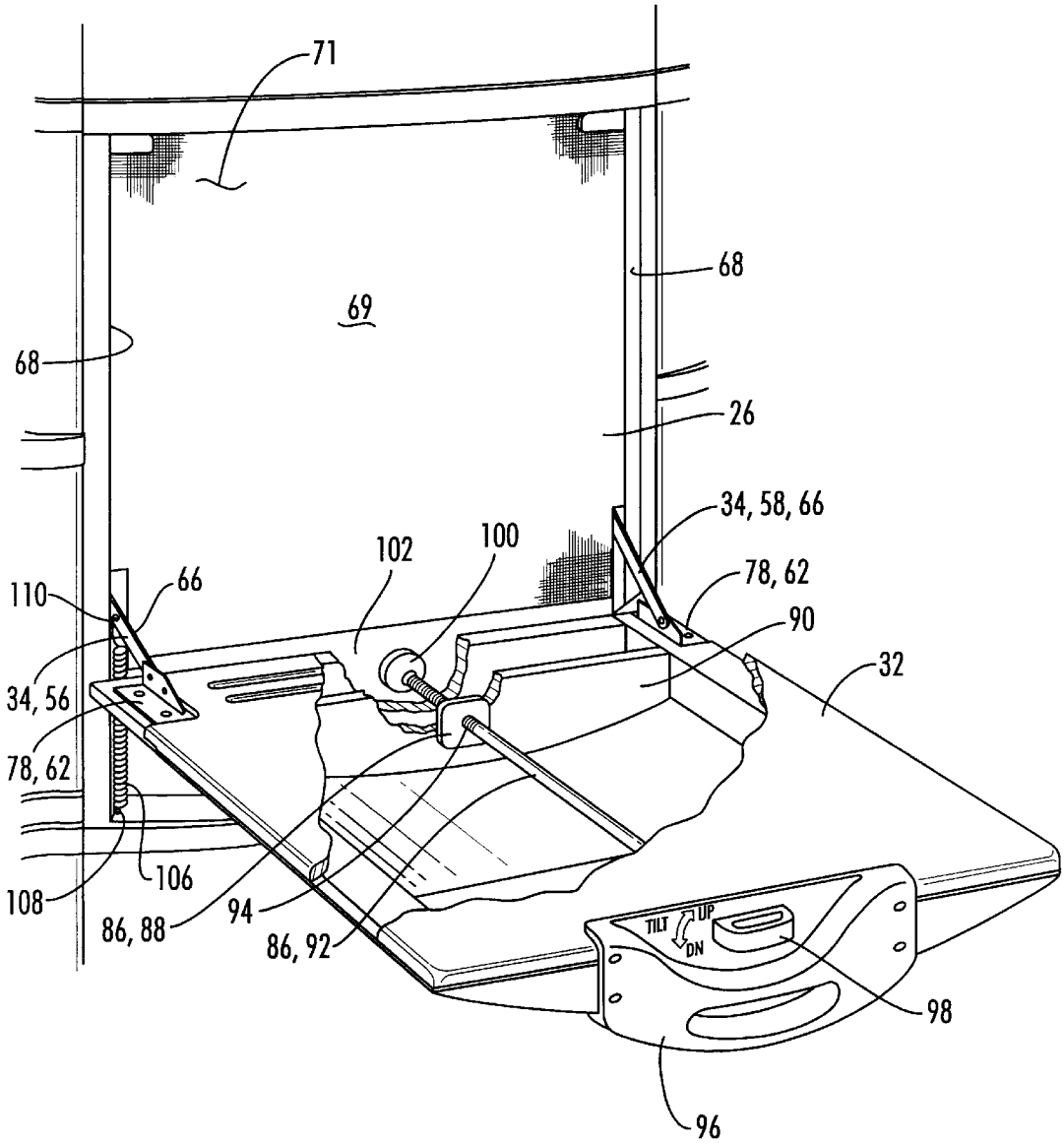
FIG. 5 is a perspective view of the door and desk of FIG. 4 taken from the front. Again, the desk is shown in an open position. Furthermore, portions of the desk are cut away to show the leveler mechanism which is located internally of the desk panel.
Figure 7:
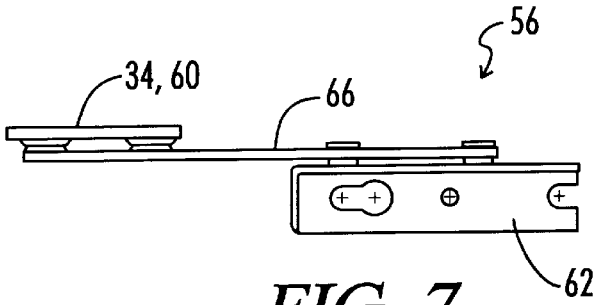
FIG. 7 is a top view of the linkage of FIG. 6 when the linkage is in the open position represented by the dashed lines of FIG. 6.

The plate 60 is bolted to the outside of framework 68. The second plate 62 is bolted or screwed to the desk panel 32 as best seen in FIG. 5.

The bars 64 and 66 are connected to the plates 60 and 62 by four pivot pins 70, 72, 74, and 76.

As is apparent in viewing FIG. 6, the motion of the desk panel 32 as it moves from its closed to its open position is generally parallel to that of an outer planar surface 78 of plate 62. As noted, the plate 78 is shown in solid lines in its position corresponding to the closed position of the desk panel. As the desk panel 32 is tilted downwardly toward its open position, the plate 62 will actually swing upwardly and outwardly as it pivots clockwise about a varying horizontal axis until it reaches the final position shown in dashed lines in FIG. 6.

Various springs, dampeners and latches may be used in conjunction with the hinge assembly 34, in order to control the motion thereof. For example, spring 106 seen in FIG. 5 may be utilized to dampen the downward movement of the desk panel 32. A lower end 108 of the spring is attached to the framework 68, and an upper end 110 of the spring is attached to the bar 66.

As is apparent in FIG. 6, the typical open position of the desk panel 32 will be tilted downwardly toward the user. This allows the desk panel 32 to function very effectively as a writing desk.

The framework 68 includes an overhead panel 79, best seen in FIG. 4. A light fixture 80 is located in the overhead panel 79 and is directed upon the desk panel 32 when the desk panel 32 is in its extended or open position as shown in FIG. 4. The light fixture 80 is hidden from view when the desk panel 32 is in its closed position of FIG. 1.

As seen in FIG. 4, associated with the right hinge mechanism 58 is a combination handle and hinge cover 82. The handle and hinge cover 82 connects to the door 26 and covers the hinge mechanism 58. An indentation 84 therein forms a hand grip for pulling the door 26 open.

As best seen in FIG. 5, the desk panel 32 includes a leveler mechanism 86 connected between the desk panel 32 and the door 26 for adjusting a tilt of the desk panel 32 when the desk panel 32 is in its open position. The leveler mechanism 86 includes a threaded plate or nut 88 which is attached by screws or the like to a cross-piece 90 of the desk panel 32.

Leveler assembly 86 further includes a rotatable threaded shaft or rod 92 having a threaded portion thereon which is threadedly received through a threaded bore 94 defined in plate 88.

Located on the front edge of desk panel 32 is a desk handle assembly 96. The rotatable shaft 92 extends through the handle assembly 96 and has an adjustment handle 98 attached to one end thereof for rotating the shaft 92.

The other end of shaft 92 has a stop shoe 100 attached thereto which abuts a forward facing surface 102 of door 26. It will be appreciated that clockwise rotation of the handle 98 and rod 92 will move the stop shoe 100 away from plate 88, and counterclockwise rotation will move the stop shoe 100 closer to plate 88.

The stop shoe 100 will abut the surface 102 to effectively define the downward or open position of desk panel 32.

Thus, by rotating handle 98 and shaft 92 clockwise and moving stop shoe 100 further away from plate 88, the forward tilt of desk panel 32 will be decreased. The desk panel 32 can, in fact, be raised with the leveler mechanism 86 to a substantially leveled position so that the desk panel 32 may be used as a table top for holding a food tray or the like.

It is noted that the stop shoe 100 engages the surface 102 of door 26 at a location below the hinge mechanisms 56 and 58 and more importantly, below the moving pivotal axis of the desk panel 32 so that extension of the stop shoe 100 will cause the desk panel 32 to be moved upward toward a level position.

Figure 8:
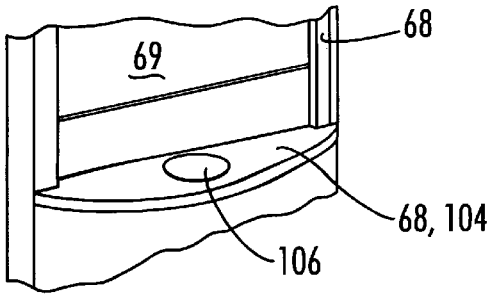
FIG. 8 is a perspective view of a portion of the door, viewed from the front, and showing a recess in the door panel which receives a stop shoe of the leveler mechanism when the desk is in a closed position. The desk has been removed from the door in FIG. 8 for purposes of illustration.

Referring now to FIG. 8, it is noted that the framework 68 defining opening 69 includes a lower panel 104 which is located immediately below desk panel 32 when the desk panel 32 is in its closed position. The lower panel 104 has a recess 106 defined therein within which the stop shoe 100 can be received when the desk panel 32 is pivoted upward to its closed position. This allows the desk panel 32 to be closed regardless of the adjusted position of the stop shoe 100. Thus, when the desk panel 32 is re-opened, it will move back to the same position in which it was located prior to being closed.

The leveler mechanism 86 may also be referred to as a tilt adjusting mechanism 86 for defining the lower use position of the desk panel 32 relative to the door 26.

Thus, it is seen that the apparatus of the present invention readily achieves the ends and advantages mentioned, as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A furniture apparatus, comprising:

an enclosure having an opening defined therein;

a door located in the opening, the door having an outside having a convex curved outer door surface;

a door hinge connecting the door to the enclosure so that the door pivots on the door hinge about a generally vertical axis relative to the enclosure;

a desk panel mounted in the outside of the door;

a desk hinge connecting the desk panel to the door so that the desk panel pivots relative to the door between a retracted position wherein the desk panel is received in the door, and an extended position wherein the desk panel extends outward from the door; and wherein the desk panel has a convex curved outer desk surface that lies generally co-extensive with the convex curved outer door surface so as to appear as a part thereof when the desk panel is in its retracted position.

2. The apparatus of claim 1, wherein:

the desk hinge comprises a pair of four-bar linkage hinge mechanisms located on opposite sides of the desk panel so that the desk panel pivots about a varying horizontal axis as the desk panel moves from its retracted position to its extended position.

3. The apparatus of claim 1, wherein:

the door has an outward facing cavity defined therein within which the desk panel is received in its retracted position, the door including an overhead panel defining an upper end of the cavity; and the apparatus further includes a light fixture located in the overhead panel and directed upon the desk panel when the desk panel is in its extended position.

4. A furniture apparatus comprising:

an enclosure having an opening defined therein;

a door located in the opening the door having an outside;

a door hinge connecting the door to the enclosure so that the door pivots on the door hinge about a generally vertical axis relative to the enclosure;

a desk panel mounted in the outside of the door;

a desk hinge connecting the desk panel to the door so that the desk panel pivots relative to the door between a retracted Position wherein the desk panel is received in the door, and an extended position wherein the desk panel extends outward from the door; and a leveler mechanism connected between the desk panel and the door for adjusting a tilt of the desk panel when the desk panel is in its extended position.

5. The apparatus of claim 4, wherein the leveler mechanism comprises:

a threaded opening defined in the desk panel;

a rotatable threaded shaft threadedly received through the threaded opening, the shaft having a shaft end defined thereon for engaging the door at a point below the desk hinge so that downward pivotal movement of the desk panel relative to the door is limited by engagement of the shaft end with the door.

6. The apparatus of claim 4, wherein:

the leveler mechanism is so arranged and constructed that the desk panel can be moved to its retracted position regardless of the position of the leveler mechanism.

7. A furniture apparatus, comprising:

a primary structure having a primary outer surface having a convex curvature in plan view; and a desk panel mounted upon the primary structure, the desk panel being pivotable between an upper storage position and a lower use position relative to the primary structure, the desk panel including a convex curved outer desk surface that lies generally co-extensive with the convex curved primary outer surface when the desk panel is in its upper storage position.

8. The apparatus of claim 7, further comprising:

first and second hinge mechanisms located on opposite sides of the desk panel and connected between the primary structure and the desk panel.

9. The apparatus of claim 8, wherein:

each of the hinge mechanisms includes a four-bar linkage.

10. The apparatus of claim 7, further comprising:

a tilt adjusting mechanism for defining the lower use position of the desk panel relative to the primary structure.

11. The apparatus of claim 10, wherein the tilt adjusting mechanism comprises:

a threaded nut attached to the desk panel;

a rotatable adjustment rod threadedly received through the threaded nut;

a handle attached to one end of the-rod for rotating the rod; and a stop shoe attached to the other end of the rod for engaging the primary structure and thereby limiting downward movement of the desk panel relative to the primary structure.

12. A furniture apparatus constructed to be received in a corner of a room defined by two converging room walls comprising:

at least two converging planar back wall segments;

a convexly curved front primary surface facing away from the back wall segments;

a vertically hinged door having a convexly curved door front surface defining a portion of the convexly curved front primary surface; and a desk panel carried by the door and pivotally mounted on the door, the desk panel having a desk panel outer surface defining a portion of the convexly curved door front surface when the desk panel is in a retracted storage position relative to the door.

13. The apparatus of claim 12, wherein:

the apparatus is an armoire, including an interior closet space defined therein, the closet space being accessible via the door.

14. The apparatus of claim 13, further comprising:

a full length mirror mounted on an inside of the door.

15. The apparatus of claim 13, further comprising:

an integral television cabinet located above the door.

16. The apparatus of claim 12, further comprising:

a lighting fixture mounted in the door for illuminating the desk panel when the desk panel is in an open position, the lighting fixture being hidden by the desk panel when the desk panel is in its retracted position.

17. The apparatus of claim 12, further comprising:

a four-bar linkage desk hinge connecting the desk panel to the door so that the desk panel may pivot from its retracted position downwardly and outwardly to an open position.

18. The apparatus of claim 12, further comprising:

a leveler mechanism for adjusting a tilt angle of the desk panel when the desk panel is in an open position.

* * * * *